US010562149B2

(12) United States Patent
Fu et al.

(10) Patent No.: US 10,562,149 B2
(45) Date of Patent: Feb. 18, 2020

(54) POLYURETHANE CMP PADS HAVING A HIGH MODULUS RATIO

(71) Applicant: Cabot Microelectronics Corporation, Aurora, IL (US)

(72) Inventors: Lin Fu, Naperville, IL (US); Rui Ma, Naperville, IL (US); Nathan Speer, Oak Park, IL (US); Chen-Chih Tsai, Naperville, IL (US); Kathryn Bergman, Chicago, IL (US)

(73) Assignee: Cabot Microelectronics Corporation, Aurora, IL (US)

( * ) Notice: Subject to any disclaimer, the term of this patent is extended or adjusted under 35 U.S.C. 154(b) by 130 days.

(21) Appl. No.: 15/273,855

(22) Filed: Sep. 23, 2016

(65) Prior Publication Data

US 2017/0087688 A1 Mar. 30, 2017

Related U.S. Application Data

(60) Provisional application No. 62/232,837, filed on Sep. 25, 2015.

(51) Int. Cl.
*B24B 37/24* (2012.01)
*B24B 37/04* (2012.01)
(Continued)

(52) U.S. Cl.
CPC ..... *B24B 37/24* (2013.01); *B24B 37/042* (2013.01); *B24B 37/22* (2013.01); *B24B 37/14* (2013.01); *B24D 18/0045* (2013.01)

(58) Field of Classification Search
CPC ..... B24B 37/14; B24B 37/22; B24B 37/24; B24B 37/042; B24D 18/0045
See application file for complete search history.

(56) References Cited

U.S. PATENT DOCUMENTS 5,489,233 A 2/1996 Cook et al.
5,769,691 A 6/1998 Fruitman
(Continued)

FOREIGN PATENT DOCUMENTS

CN 1265618 A 9/2000
CN 101428403 A 5/2009
(Continued)

OTHER PUBLICATIONS

Taiwan Intellectual Property Office, Search Report issued in connection with Taiwan Patent Application No. 105131001 dated Apr. 6, 2017.
(Continued)

*Primary Examiner* — Timothy V Eley
(74) *Attorney, Agent, or Firm* — Thomas Omholt; Erika S. Wilson

(57) ABSTRACT

A chemical-mechanical polishing pad comprising a polyurethane polishing layer having a high storage modulus at low temperatures and a low storage modulus at high temperatures is disclosed. For example, the disclosed pad embodiments may be fabricated from a thermoplastic polyurethane having a ratio of storage modulus at 25 degrees C. to storage modulus at 80 degrees C. of 50 or more. The thermoplastic polyurethane polishing layer may further optionally have a Shore D hardness of 70 or more, a tensile elongation of 320 percent or less, a storage modulus at 25 degrees C. of 1200 MPa or more, and/or a storage modulus at 80 degrees C. of 15 MPa or less.

16 Claims, 4 Drawing Sheets

(51) Int. Cl.

| | |
|---|---|
| ***B24B 37/22*** | (2012.01) |
| ***B24D 18/00*** | (2006.01) |
| ***B24B 37/14*** | (2012.01) |

(56) References Cited

U.S. PATENT DOCUMENTS

| | | | | |
|---|---|---|---|---|
| 6,022,268 | A | 2/2000 | Roberts et al. | |
| 6,176,763 | B1 | 1/2001 | Kramer et al. | |
| 6,203,407 | B1 | 3/2001 | Robinson | |
| 6,454,634 | B1 | 9/2002 | James et al. | |
| 6,582,283 | B2 | 6/2003 | James et al. | |
| 6,706,383 | B1 * | 3/2004 | Obeng | B24B 37/24 428/304.4 |
| 6,893,325 | B2 | 5/2005 | Robinson | |
| 7,458,885 | B1 | 12/2008 | Palaparthi | |
| 8,491,360 | B2 * | 7/2013 | Lefevre | B24B 37/24 451/532 |
| 8,512,427 | B2 * | 8/2013 | Xie | B24B 37/24 451/526 |
| 9,156,127 | B2 * | 10/2015 | Fukuda | B24B 37/24 |
| 2001/0046834 | A1 * | 11/2001 | Ramana | B24B 37/24 451/526 |
| 2002/0155801 | A1 | 10/2002 | Roberts et al. | |
| 2004/0177563 | A1 * | 9/2004 | Prasad | B24B 37/24 51/298 |
| 2005/0276967 | A1 * | 12/2005 | Prasad | B24B 37/24 428/314.8 |
| 2009/0258573 | A1 * | 10/2009 | Muldowney | B24B 37/24 451/5 |
| 2011/0256817 | A1 * | 10/2011 | Fukuda | B24B 37/24 451/526 |
| 2012/0252324 | A1 | 10/2012 | Hreha et al. | |
| 2016/0101500 | A1 * | 4/2016 | Fung | B24B 37/015 156/345.12 |
| 2016/0136787 | A1 * | 5/2016 | Bajaj | B24B 37/22 51/298 |
| 2017/0203408 | A1 * | 7/2017 | Ganapathiappan | B24B 37/24 |
| 2017/0203409 | A1 * | 7/2017 | Lefevre | B24B 37/26 |

FOREIGN PATENT DOCUMENTS

| | | | |
|---|---|---|---|
| EP | 2128894 | A1 | 12/2009 |
| WO | 9907515 | A | 2/1999 |

OTHER PUBLICATIONS

Korean Intellectual Property Office Acting as ISA, International Search Report issued in connection with PCT/US2016/053283 dated Dec. 27, 2016.

China Intellectual Property Office, Office Action issued in connection with CN201680054351.8 dated Aug. 22, 2019.

* cited by examiner

POLYURETHANE CMP PADS HAVING A HIGH MODULUS RATIO

FIELD OF THE INVENTION

The disclosed embodiments are related to chemical-mechanical polishing pads and more particularly to pads fabricated from a polyurethane material having a high storage modulus at low temperatures and a low storage modulus at high temperatures.

BACKGROUND OF THE INVENTION

A number of chemical-mechanical polishing (CMP) operations are used in both front-end-of-the-line (FEOL) and back-end-of-the-line (BEOL) processing of semiconductor devices. For example, the following CMP operations are commonly employed. Shallow trench isolation (STI) is an FEOL process used prior to formation of the transistors. A dielectric such as tetraethyl orthosilicate (TEOS) is deposited in openings formed in the silicon wafer. A CMP process is then used to remove the excess TEOS resulting in a structure in which a predetermined pattern of TEOS is inlaid in the silicon wafer. Tungsten plug and interconnect and copper interconnect and dual damascene processes are BEOL processes used to form the network of metal wires that connect the device transistors. In these processes tungsten or copper metal is deposited in openings formed in a dielectric material (e.g., TEOS). CMP processes are used to remove the excess tungsten or copper from the dielectric to form tungsten or copper plugs and/or interconnects therein. An interlayer dielectric (ILD) material (such as TEOS) is deposited between metal interconnect levels to provide electrical insulation between the levels. An ILD CMP step is commonly employed to smooth and planarize the deposited insulating material prior to building up the subsequent interconnect level.

In a conventional CMP operation, the substrate (wafer) to be polished is mounted on a carrier (polishing head) which is in turn mounted on a carrier assembly and positioned in contact with a polishing pad in a CMP apparatus (polishing tool). The carrier assembly provides a controllable pressure to the substrate, pressing the substrate against the polishing pad. A chemical-mechanical polishing composition is generally applied to the surface of the pad while the substrate and pad are moved relative to one another. The relative motion of the substrate and pad (and the applied polishing composition) abrades and removes a portion of the material from the surface of the substrate, thereby polishing the substrate. Polishing of the substrate is generally aided by the chemical activity of the polishing composition (e.g., by a chemical accelerator) and/or the mechanical activity of an abrasive suspended in the polishing composition.

Polishing pads made of harder materials tend to exhibit higher removal rates, superior planarization efficiency, and a longer useful pad life than polishing pads made of softer materials. However, harder pads also tend to impart more defects (such as scratches) to the wafer surface than softer pads. There remains a need in the industry for polishing pads that are capable of achieving high removal rates and planarization efficiency, long pad life, and reduced defectivity. Currently available pads are deficient in at least one of these categories.

BRIEF SUMMARY OF THE INVENTION

A chemical-mechanical polishing pad comprising a polyurethane polishing layer having a high storage modulus at low temperatures and a low storage modulus at high temperatures is disclosed. For example a ratio of storage modulus at 25 degrees C. to storage modulus at 80 degrees C. may be 30 or more. The polyurethane polishing layer may further optionally have a Shore D hardness of 70 or more, a tensile elongation of 320 percent or less, a storage modulus at 25 degrees C. of 1200 MPa or more, and/or a storage modulus at 80 degrees C. of 15 MPa or less.

Disclosed pads may provide various advantages, for example, including high planarization efficiency and low defectivity. The disclosed pads may further provide stable CMP removal rates when used with mild conditioning routines. The use of mild conditioning routines may further promote a significant increase in pad life.

BRIEF DESCRIPTION OF THE DRAWINGS

For a more complete understanding of the disclosed subject matter, and advantages thereof, reference is now made to the following descriptions taken in conjunction with the accompanying figures.

DETAILED DESCRIPTION OF THE INVENTION

Figure 1:
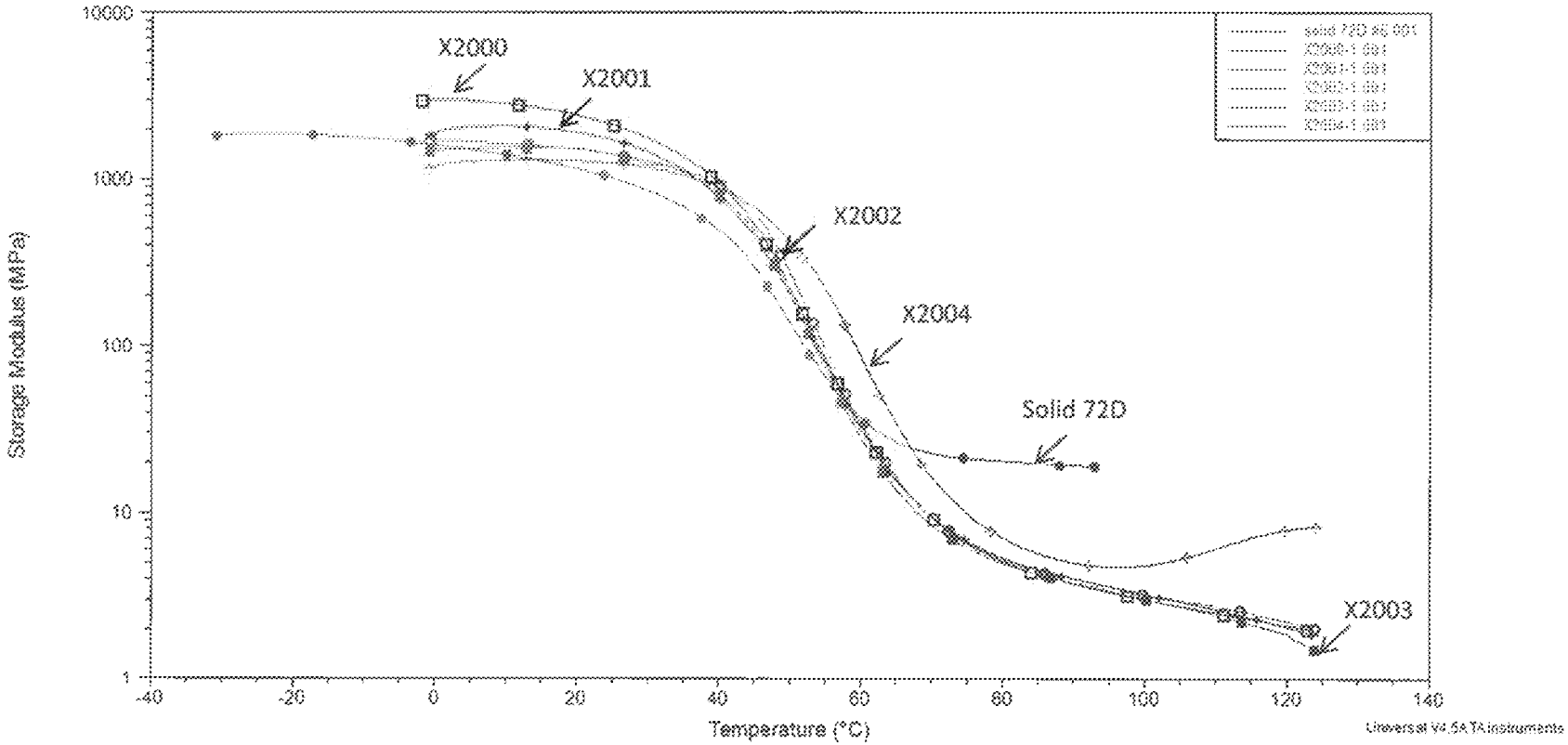
FIG. 1 depicts a plot of the storage modulus E' as a function of temperature for five disclosed pad embodiments and a control embodiment.

A chemical-mechanical polishing pad comprising a polyurethane polishing layer having a high storage modulus at low temperatures and a low storage modulus at high temperatures is disclosed. For example, in suitable pad embodiments the polyurethane polishing layer may have ratio of storage modulus at 25 degrees C. to storage modulus at 80 degrees C. of 30 or more.

The invention is directed to a chemical-mechanical polishing pad substrate comprising a polyurethane material. The invention is predicated, at least in part, on the surprising and unexpected discovery of a polishing pad for chemical-mechanical polishing with good planarization efficiency, reduced defectivity (e.g., scratches), ease of conditioning, and long pad life. Certain embodiments of the inventive pad may be described as being low toughness, high modulus, and/or hard pads and may be characterized as having specific mechanical properties.

The polishing pad of the invention has applicability in polishing a wide variety of semiconductor wafers used in fabrication of integrated circuits and other microdevices. Such wafers can be of conventional node configuration in some embodiments, e.g., technology nodes of 90 nm or less, 65 nm or less. 45 nm or less, 32 nm or less, etc. However, in some embodiments, the inventive polishing pad is particularly suited for advanced node applications (e.g., technology nodes of 22 nm or less, 18 nm or less, 16 nm or less, 14 nm or less, etc.). It will be understood that, as node technology becomes more advanced, the absence of defectivity in planarization technology becomes more important because the effects of each scratch have more of an impact as the relative size of features on the wafer gets smaller. Owing to the improvement in defectivity provided, the disclosed polishing pads may be particularly suitable for advanced note applications. However, as noted, the polishing pad of the invention is not limited to use with advanced node wafers and can be used to polish other workpieces as desired.

The pads may be fabricated from a thermoplastic or a thermosetting polyurethane polymer resin. Preferred embodiments employ a thermoplastic polyurethane polymer resin. The polymer resin typically is a pre-formed polymer resin; however, the polymer resin may also be formed in situ according to any suitable method, many of which are known in the art (see, for example, Szycher's Handbook of Polyurethanes, CRC Press: New York, 1999, Chapter 3). For example, a thermoplastic polyurethane can be formed in situ by reaction of urethane prepolymers, such as isocyanate, di-isocyanate, and tri-isocyanate prepolymers, with a prepolymer containing an isocyanate reactive moiety. Suitable isocyanate reactive moieties include amines and polyols.

The selection of the polyurethane polymer resin may depend, in part, on the rheology of the polymer resin. Commonly assigned U.S. Pat. No. 8,075,372, which is fully incorporated by reference herein, discloses suitable rheological properties for thermoplastic polyurethane pads. In preferred embodiments a thermoplastic polyurethane has an average molecular weight of less than 150,000 g/mol (e.g., less than 100,000 g/mol). The use of lower molecular weight polyurethanes may advantageously result in a "brittle" (less ductile) pad material and thereby enable mild pad conditioning routines to be suitably utilized.

Suitable polyurethane materials may further be selected based on the mechanical properties imparted to the pad (e.g., as determined via dynamic mechanical analysis). In particular, the polishing pads are preferably fabricated from a polyurethane having a high modulus at low temperature (such as 25° C., 30° C., and/or 40° C.) and a low modulus at high temperature (such as at 70° C., 80° C., and/or 90° C.). While not wishing to be bound by theory, it is believed that during polishing the bulk pad temperature remains low (e.g., in a range from about 30° C. to about 50° C.) while the pad asperity temperature can be high (e.g., about 80° C.). The high modulus at low temperatures provides pad rigidity and is believed to promote a high planarization efficiency while the low modulus at high temperatures provides softness that is believed to promote low defectivity.

At low temperatures the storage modulus is preferably very high. For example, at 25° C. the storage modulus (E') of thermoplastic polyurethanes is preferably about 1000 MPa or more (e.g., about 1200 MPa or more, or about 1400 MPa or more). At 30° C. the storage modulus is preferably about 800 MPa or more (e.g., about 1000 MPa or more, or about 1200 MPa or more). At 40° C. the storage modulus is preferably about 600 MPa or more (e.g., about 700 MPa or more, or about 800 MPa or more). For thermosetting polyurethanes, the storage modulus is preferably about 300 MPa or more (e.g., 400 MPa or more, or 500 MPa or more) at temperatures less than about 50° C.

At high temperatures the storage modulus is preferably very low. For example, for thermoplastic polyurethanes at 80° C. or 90° C. the storage modulus is preferably about 20 Mpa or less (e.g., about 15 MPa or less, or about 10 MPa or less). At 70° C. the storage modulus is preferably about 30 MPa or less (e.g., about 20 MPa or less, or about 15 MPa or less). For thermosetting polyurethanes the storage modulus is preferably about 20 Mpa or less (e.g., about 15 MPa or less, or about 10 MPa or less) at temperatures above 80° C.

The polyurethane may also be characterized as having a high ratio of the low temperature to high temperature storage moduli. For example, for thermosetting polyurethanes, the ratio of the storage modulus at 25° C. to the storage modulus at 80° C. (E' (25): E'(80)) is preferably about 30 or more (e.g., about 40 or more, or about 50 or more, or about 80 or more, or about 100 or more). For thermoplastic polyurethanes, the E' (25): E'(80) ratio is preferably about 50 or more (e.g., about 80 or more, or about 100 or more, or about 120 or more, or about 150 or more). Using an alternative ratio, the ratio of the storage modulus at 40° C. to the storage modulus at 80° C. (E' (40): E'(80)) may be about 30 or more (e.g., about 40 or more, or about 50 or more, or about 60 or more, or about 80 or more, or about 100 or more). For thermoplastic polyurethanes, the E' (40): E'(80) ratio is preferably about 50 or more.

The disclosed pads are further preferably constructed from a hard polyurethane material, for example, having a Shore D hardness (ASTM D2240-95) about 60 or more (e.g., about 70 or more, or about 75 or more). The use of a hard pad is also believed to further promote a high planarization efficiency.

The polyurethane may also be characterized as being somewhat brittle (or said in another way as having a low toughness or a low tensile elongation). For example, the tensile elongation at room temperature (e.g., about 25° C.) is preferably about 350 percent or less (e.g., about 340 percent or less, or about 320 percent or less, or about 300 percent or less). While not wishing to be bound by theory, it is hypothesized that tough pads such as those having a high tensile elongation (e.g., greater than about 350 percent) tend to require more aggressive conditioning (due to the higher energy required to fracture/shear/tear the pad material). Thus, the use of a lower toughness polyurethane (e.g., one having a lower tensile elongation) may result in a pad that requires less aggressive conditioning which may in turn promote an extended pad life.

In one preferred embodiment, the polishing pad is fabricated from a thermoplastic polyurethane having a E' (25): E'(80) ratio of about 100 or more, a storage modulus E' (25) of about 1000 MPa or more, a storage modulus E' (80) about 20 or less, a Shore D hardness of about 70 or more, and a tensile elongation about 320 percent or less.

The disclosed pads are preferably non-porous, but may also include porous embodiments. Non-porous pads are those which are substantially fully solid, i.e., having a pore volume percentage substantially equal to zero. In such embodiments, the pad has a density greater than 1 g/cm3 (e.g., in a range from about 1.1 to about 1.2 g/cm3).

In certain embodiments, the disclosed pads may also be porous, having substantially any suitable pore size and pore volume. For example, the pad may have an average pore size in a range from about 5 to about 200 μm (e.g., in a range from about 5 to about 100 μm, or in a range from about 5 to about 50 μm). Such pads may also have a porosity volume percentage (also referred to as a void volume) in a range from about 1 to about 50 volume percent (e.g., from about 5 to about 50 percent, or from about 10 to about 40 percent).

In porous pad embodiments, the pores may be imparted into the polyurethane using substantially any suitable techniques. For example, a solid state foaming process may be employed in which extruded sheets are exposed to a high pressure inert gas (such as carbon dioxide) such that the inert gas is absorbed in the sheets. Nucleation of gas bubbles in the sheet then causes porosity. Commonly assigned U.S. Patent Publications 2015/0056892, which is incorporated by reference in its entirety herein, discloses a suitable foaming technique.

The disclosed pads may be fabricated using substantially any suitable pad manufacturing techniques. For example, in one suitable method embodiment, a liquid thermoplastic polyurethane polymer resin mixture may be blended and then extruded to form a solid thermoplastic polyurethane sheet. Polishing pads may then be formed from the sheet.

The following examples further illustrate the invention but, of course, should not be construed as in any way limiting its scope.

Example 1

The mechanical properties were evaluated in this example for various extruded thermoplastic polyurethane pads (five inventive embodiments and one control embodiment). The evaluated pads were solid (having essentially no porosity). The five inventive embodiments are shown in Tables 1A and 1B as pad samples 1A, 1B, 1C, 1D, and 1E. The inventive pad samples were fabricated using conventional thermoplastic polyurethane processing techniques by varying three parameters; (i) the hard segment to soft segment ratio, (ii) the ratio of a first polyol to a second polyol, and (iii) the ratio of a first chain extender to a second chain extender as shown in Table 1A.

TABLE 1A

| Pad | Hard Segment to Soft Segment | Polyol1 to Polyol2 | Chain Extender 1 to Chain Extender 2 |
|---|---|---|---|
| 1A | Low | Level 1 | Level A |
| 1B | Low | Level 1 | Level B |
| 1C | Low | Level 2 | Level A |
| 1D | X-Low | Level 1 | Level A |
| 1E | High | Level 1 | Level B |

The control embodiment was the commercially available Epic D100® pad (Cabot Microelectronics, Aurora, Ill.). The evaluated properties include, the glass transition temperature Tg, the DMA transition temperature (the temperature at which tan δ is a maximum), the percent elongation at tensile failure, the storage modulus at 25° C. E' (25), the storage modulus at 50° C. E' (50), the storage modulus at 80° C. E' (80), and the ShoreD hardness, and the thermoplastic polyurethane material density. The pad material properties are shown in Table 1B.

TABLE 1B

| Pad | Tg (DSC) ° C. | DMA Transition Temp ° C. | Percent Elongation | E' (25) MPa | E' (50) MPa | E' (80) MPa | Hardness ShoreD |
|---|---|---|---|---|---|---|---|
| 1A | 43.4 | 60.8 | 259 | 2127 | 215 | 5 | 77.2 |
| 1B | 44.0 | 60.3 | 292 | 1725 | 204 | 5 | 77.8 |
| 1C | 44.5 | 60.3 | 312 | 1413 | 276 | 5 | 76.4 |
| 1D | 43.6 | 59.9 | 194 | 1590 | 317 | 5 | 76.9 |
| 1E | 45.5 | 66.8 | 318 | 1474 | 441 | 8 | 80.1 |
| Control | | 56 | 350 | 1000 | 141 | 19 | 72 |

Based on the data in Table 1B, the inventive samples have a higher DMA transition temperature, a lower percent elongation, a higher storage modulus at 25 and 50° C., a lower storage modulus at 80° C., and a higher Shore D hardness than the control pad. As described in more detail below, these properties (alone or in combination) are believed to provide the superior pad conditionability, planarity efficiency, and defectivity performance achieved.

FIG. 1 depicts a plot of the storage modulus E' as a function of temperature for pad samples 1A, 1B, 1C, 1D, 1E (blue, brown, magenta, cyan, and green in the informal drawings) and the control (red/orange in the informal drawings). The data in the plot was generated using a Q800 DMA measurement tool available from TA Instruments. The tests were conducted following a standard Multi-frequency controlled strain Tensile Mode, with a frequency of 1 Hz, an amplitude of 30 μm and a temperature ramp of 5° C./min from 0 to 120° C. Each pad sample was formed into a 6 mm by 30 mm rectangular shape for the tensile clamp.

The data depicted on FIG. 1 demonstrate that the inventive pad samples have higher storage modulus E' values at low temperatures (e.g., less than about 50° C.) than the control sample. The depicted data further demonstrate that the inventive pad samples have lower storage modulus E' values at high temperatures (e.g., greater than about 60° C.) than the control sample.

Example 2

The copper removal rate was evaluated for a 250 wafer run using inventive pad sample 1D and the control (an Epic D100® pad available from Cabot Microelectronics). This example evaluated the effectiveness of the inventive pad sample when using a mild pad conditioning routine (described below). Two inventive pad samples were evaluated; (i) a solid, non-porous pad (1DS) and (ii) a foamed porous pad (1DF) having a porosity similar to that of the control pad. Each of the inventive pad samples included a concentric groove pattern identical to that of the commercially available Epic D100® pad.

Copper polishing rates were obtained by polishing 200 mm blanket copper wafers using an alumina based polishing slurry as described in U.S. Pat. No. 6,217,416, on an Applied Materials Mirra CMP polisher equipped with a Titan Profiler head. The slurry had 1.5% hydrogen peroxide at point of use. A high- and low-downforce recipe was used to approximate the first two steps used in semiconductor manufacturing. The high downforce recipe used a platen speed of 93 rpm, a head speed of 87 rpm, and a membrane pressure of 2.5 psi. The low-downforce recipe used a platen and head speed of 70 and 63 rpm, respectively and a membrane pressure of 1.5 psi. The slurry flow-rate was 200 mL/min and the polishing pads were conditioned for 100% of the polishing step, in-situ, using a Kinik 31G-3N conditioning disk with a 10 zone sinusoidal sweep frequency of 12 cycles per minute.

Figure 2:
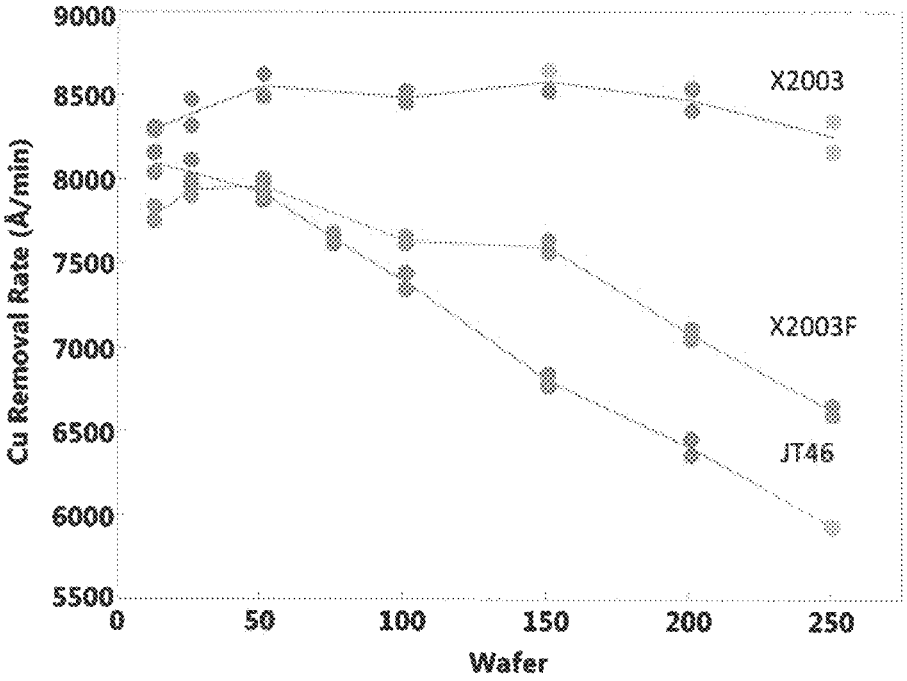
FIG. 2 depicts a plot of the copper removal rate versus the number of wafers polished for the inventive pad embodiments 1DS and 1DF (X2003, X2003F) and the control (D100-JT46).

FIG. 2 depicts a plot of the copper removal rate versus the number of wafers polished for the inventive pad embodiments 1DS and 1DF (blue and green in the informal drawings) and the control (red in the informal drawings). Note that the Cu removal rate was high and substantially constant (at about 8500 Å/min) for the solid pad over the duration of the experiment indicating that the mild conditioning routine was suitable for the 1DS pad embodiment. The removal rates of the foamed pad 1DF decreased monotonically from about 8000 to about 7000 Å/min over the duration of the experiment while the removal rates of the control pad decreased from about 8000 to about 6000 Å/min indicating that these pad embodiments likely required a more aggressive conditioning routine.

Example 3

Blanket and patterned copper wafers were polished using inventive pad samples 1A, 1B, 1C, 1D and the control (an Epic D100® pad available from Cabot Microelectronics). This example evaluated the patterned wafer performance (particularly dishing) and defectivity (particularly scratches) of the inventive samples. Both solid, non-porous (S) and foamed (F) versions of the inventive pads were evaluated. The solid pads were essentially non-porous. The foamed pads had a porosity in a range from about 10-30 volume percent with an average pore size in a range from 5-40 μm. Each of the inventive pad samples included a concentric groove pattern identical to that of the commercially available Epic D100® pad.

MIT854 copper pattern wafers (diameter 200 mm) were polished until endpoint using the same slurry as described in Example 2 on an Applied Materials Mirra CMP polisher equipped with a Titan Profiler head. A high- and low-downforce recipe was used to approximate the first two steps used in semiconductor manufacturing. The high downforce recipe used a platen speed of 93 rpm, a head speed of 87 rpm, and a membrane pressure of 2.5 psi. The low-downforce recipe used a platen and head speed of 70 and 63 rpm, respectively and a membrane pressure of 1.5 psi. The slurry flow-rate was 200 mL/min and the polishing pads were conditioned for 100% of the polishing step, in-situ, using a Kinik 31G-3N conditioning disk with a 10 zone sinusoidal sweep frequency of 12 cycles per minute. The MIT 854 copper pattern wafers were pre-measured for bulk copper thickness, and polished using the high-downforce recipe to a targeted remaining thickness of 2000 Å. The remaining copper overburden was then removed using the low-downforce recipe, where polish times were determined by an optical endpoint system.

Total defect levels were characterized after polishing using a KLA Tencor Surfscan SP1 unpatterned wafer inspection system, with a defect-size threshold set to 200 nm. Defects were classified by SEM measurement and visual inspection. Dishing and erosion were characterized using a Veeco UVx310 profilometer. Erosion was taken from the 100 μm×100 μm structure, and was defined as the profile height difference between the field and the top of the oxide spacers between copper lines. Dishing was taken from the 9×1 μm structure, and was defined as the difference between the high oxide features and the low copper features within the array structure. The specific values for both the field and the copper structure were defined from the height distributions within the regions of interest, where the field height was always taken to be the upper 97% percentile, and the height of the copper lines and oxide spacers was defined by the bottom and top 5% of the height distribution, respectively.

Figure 3:
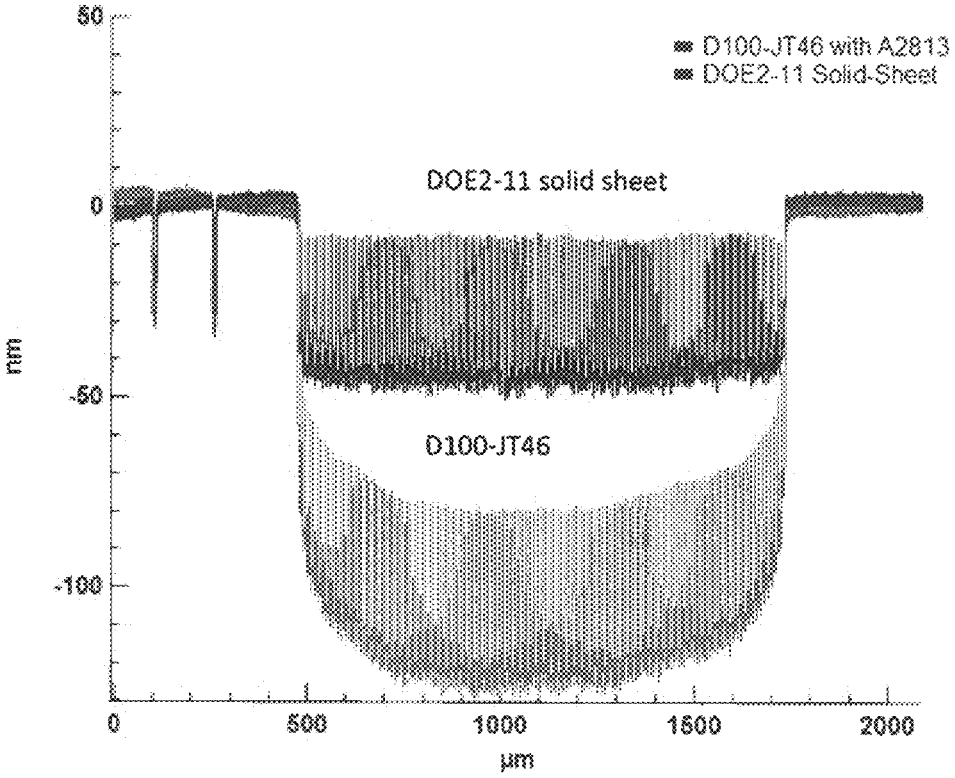
FIG. 3 depicts a profilometer scan across the surface of a 9 μm×1 μm structure on a copper patterned wafer for the inventive pad sample 1A (DOE211) and the control pad embodiment (D100).

FIG. 3 depicts a profilometer scan across the surface of the 9 μm×1 μm structure for the inventive pad sample 1A (blue in the informal drawings) and the control pad embodiment (red in the informal drawings). Note the improvement planarity (both oxide erosion and dishing) achieved using pad sample 1A.

Figure 4:
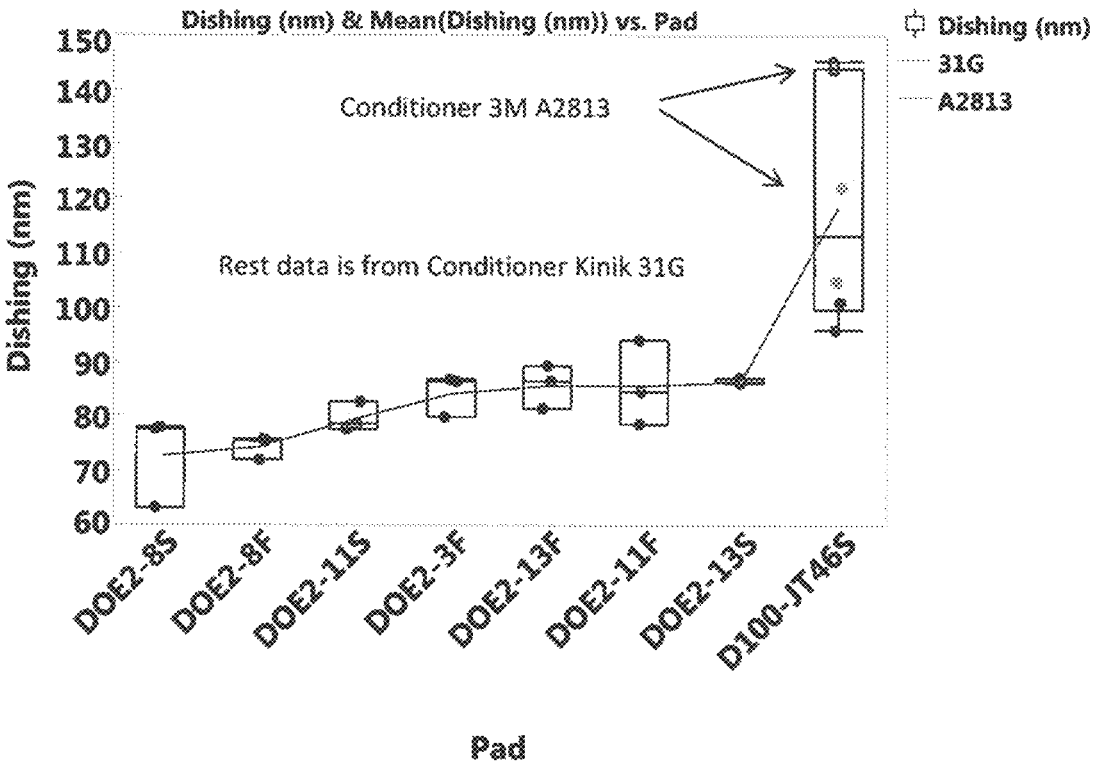
FIG. 4 depicts a plot of dishing for several of the disclosed pad embodiments.

FIG. 4 depicts a plot of dishing for several of the disclosed pad embodiments. Note that both solid and foamed embodiments of pad samples 1A, 1B, 1C, and 1D achieved improved dishing as compared to the control.

Figure 5:
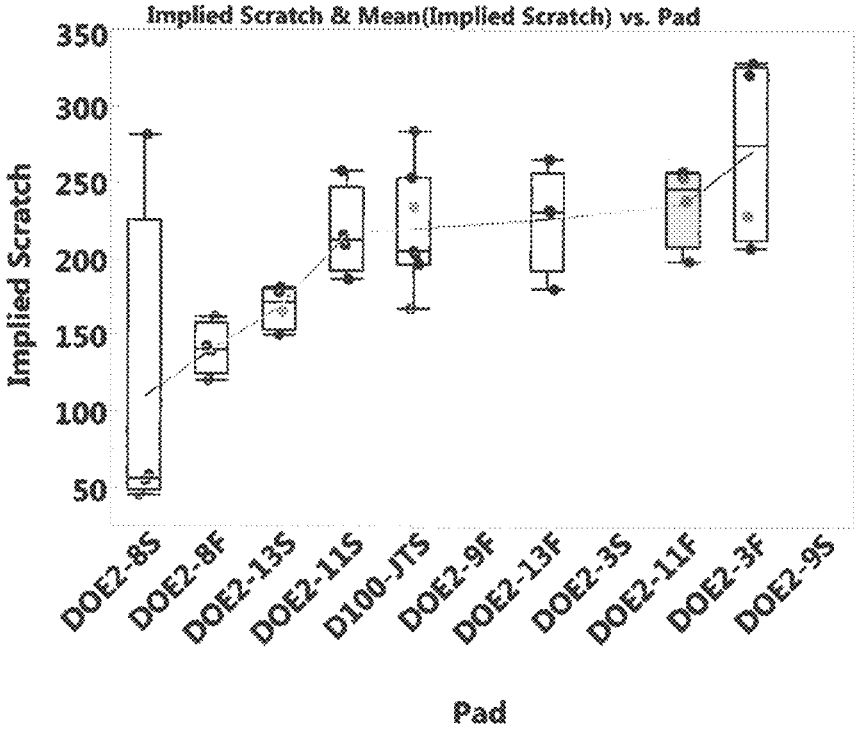
FIG. 5 depicts a plot of implied scratches for several of the disclosed pad embodiments.

FIG. 5 depicts a plot of implied scratches for several of the disclosed pad embodiments. Note that both solid and foamed embodiments of pad sample 1D and the solid pad sample 1C achieved reduced scratch performance. Pad samples 1A and 1B achieved comparable implied scratch performance.

Example 4

Figure 6:
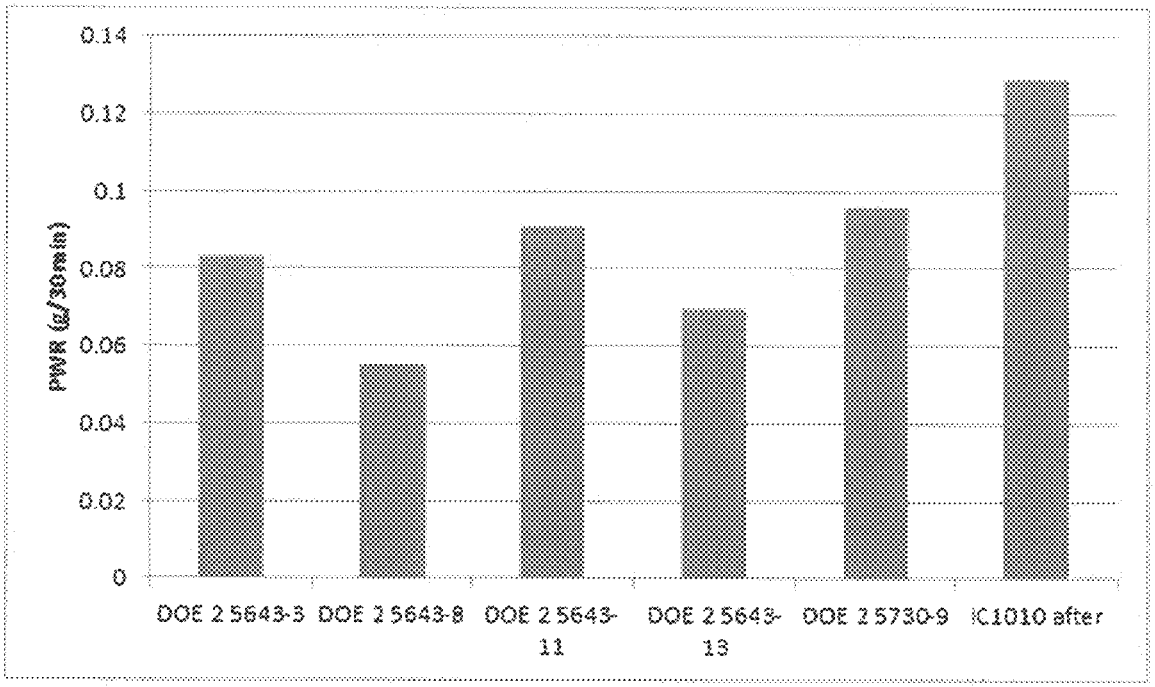
FIG. 6 depicts a plot of pad wear rates for the disclosed pad embodiments.

Pad samples 1A, 1B, 1C, 1D, and 1E were subject to a pad wear test to evaluate pad wear rates. An IC1010 pad (available from Dow Chemical) was used as the control. The pad wear test involved grinding pad samples with an A165 conditioning disk using a MiniMet1000 grinder/polisher for 1 hour. The conditioning disk was rotated at 35 rpm. A downforce of 2 lbs. was used to press the 2.25 inch diameter pad sample into contact with the conditioning disk. The slurry as described in Example 2 was applied to the disk at a flow rate ranging from about 40 to about 100 mL/min. The temperature was maintained at about 50 degrees C. The pad wear rates are depicted on FIG. 6. Note that each of the inventive pads has a lower pad wear rate than the control indicating potentially improved pad life and ease of conditioning.

It will be understood that the inventive polishing pads may optionally have a polishing surface that includes grooves, channels, and/or perforations which facilitate the lateral transport of polishing compositions across the surface of the polishing pad. Such grooves, channels, or perforations can be in any suitable pattern and can have any suitable depth and width. The polishing pad can have two or more different groove patterns, for example a combination of large grooves and small grooves as described in U.S. Pat. No. 5,489,233. The grooves can be in the form of slanted grooves, concentric grooves, spiral or circular grooves, XY crosshatch pattern, and can be continuous or non-continuous in connectivity. Preferably, the polishing pad comprises at least small grooves produced by standard pad conditioning methods.

The inventive polishing pads are particularly suited for use in conjunction with a chemical-mechanical polishing (CMP) apparatus. Typically, the apparatus comprises a platen, which, when in use, is in motion and has a velocity that results from orbital, linear, or circular motion, a polishing pad comprising the polishing pad substrate of the invention in contact with the platen and moving with the platen when in motion, and a carrier that holds a workpiece to be polished by contacting and moving relative to the surface of the polishing pad. The polishing of the workpiece takes place by placing the workpiece in contact with the polishing pad and then moving the polishing pad relative to the workpiece, typically with a polishing composition therebetween, so as to abrade at least a portion of the workpiece thereby polishing the workpiece. The polishing composition typically comprises a liquid carrier (e.g., an aqueous carrier), a pH adjustor, and optionally an abrasive. Depending on the type of workpiece being polished, the polishing composition optionally can further comprise oxidizing agents, organic acids, complexing agents, pH buffers, surfactants, corrosion inhibitors, anti-foaming agents, and the like. The CMP apparatus can be any suitable CMP apparatus, many of which are known in the art. The polishing pad comprising the polishing pad substrate of the invention also can be used with linear polishing tools.

Desirably, the CMP apparatus further comprises an in situ polishing endpoint detection system, many of which are known in the art. Techniques for inspecting and monitoring the polishing process by analyzing light or other radiation reflected from a surface of the workpiece are known in the art. Such methods are described, for example, in U.S. Pat. Nos. 5,196,353, 5,433,651, 5,609,511, 5,643,046, 5,658,183, 5,730,642, 5,838,447, 5,872,633, 5,893,796, 5,949,927, and 5,964,643. As such the inventive polishing pads may include one or more transparent windows or apertures formed therein to facilitate such endpoint detection.

The inventive polishing pads may be used alone or optionally may be used as one layer of a multi-layer stacked polishing pad. For example, the polishing pad can be used in combination with a subpad. The subpad can be any suitable subpad. Suitable subpads include polyurethane foam subpads (e.g., PORON® foam subpads from Rogers Corporation), impregnated felt subpads, microporous polyurethane subpads, or sintered urethane subpads. The subpad typically is softer than the polishing pad comprising the polishing pad substrate of the invention and therefore is more compressible and has a lower Shore hardness value than the polishing pad. For example, the subpad can have a Shore A hardness of 35 to 50. In some embodiments, the subpad is harder, is less compressible, and has a higher Shore hardness than the polishing pad. The subpad optionally comprises grooves, channels, hollow sections, windows, apertures, and the like. When the polishing pad of the invention is used in combination with a subpad, typically there is an intermediate backing layer such as a polyethyleneterephthalate film, coextensive with and between the polishing pad and the subpad.

Polishing pads comprising the polishing pad substrates of the invention are suitable for use in polishing many types of workpieces (e.g., substrates or wafers) and workpiece materials. For example, the polishing pads can be used to polish workpieces including memory storage devices, semiconductor substrates, and glass substrates. Suitable workpieces for polishing with the polishing pads include memory or rigid disks, magnetic heads, MEMS devices, semiconductor wafers, field emission displays, and other microelectronic substrates, especially microelectronic substrates comprising insulating layers (e.g., silicon dioxide, silicon nitride, or low dielectric materials) and/or metal-containing layers (e.g., copper, tantalum, tungsten, aluminum, nickel, titanium, platinum, ruthenium, rhodium, iridium or other noble metals).

The invention claimed is:

1. A chemical-mechanical polishing pad comprising a thermoplastic polyurethane polishing layer having a ratio of storage modulus at 25 degrees C. to storage modulus at 80 degrees C. of 50 or more.

2. The pad of claim 1, wherein the ratio is 100 or more.

3. The pad of claim 1, wherein the thermoplastic polyurethane polishing layer also has a ratio of storage modulus at 40 degrees C. to storage modulus at 80 degrees C. of 50 or more.

4. The pad of claim 1, wherein the thermoplastic polyurethane polishing layer has a Shore D hardness of 70 or more.

5. The pad of claim 1, wherein the thermoplastic polyurethane polishing layer has a tensile elongation of 320 percent or less.

6. The pad of claim 1, wherein the thermoplastic polyurethane polishing layer has a storage modulus at 25 degrees C. of 1000 MPa or more.

7. The pad of claim 1, wherein the thermoplastic polyurethane polishing layer has a storage modulus at 80 degrees C. of 15 MPa or less.

8. The pad of claim 1, wherein the pad is non-porous.

9. The pad of claim 1, wherein the thermoplastic polyurethane has a molecular weight of less than about 100,000 g/mol.

10. The pad of claim 1, wherein the pad has a density in a range from about 1.1 to about 1.2 g/cm3.

11. A method of chemical mechanical polishing a substrate, the method comprising:

(a) contacting the substrate with the pad of claim 1;

(b) moving the pad relative to the substrate; and (c) abrading the substrate to remove a portion of at least one layer from the substrate and thereby polish the substrate.

12. A method for fabricating the pad of claim 1, the method comprising:

(a) blending a thermoplastic polyurethane polymer resin mixture;

(b) extruding the mixture to form a solid thermoplastic polyurethane sheet;

(c) forming the polishing pad from the thermoplastic polyurethane sheet.

13. A method of chemical mechanical polishing a substrate; the method comprising:

(a) contacting the substrate with the pad of claim 1;

(b) moving the pad relative to the substrate; and (c) abrading the substrate to remove a portion of at least one layer from the substrate and thereby polish the substrate.

14. A chemical-mechanical polishing pad comprising a thermoplastic polyurethane polishing layer having a storage modulus at 25 degrees C. of 1200 MPa or more and a tensile elongation of 320 percent or less.

15. A chemical-mechanical polishing pad comprising a thermoplastic polyurethane polishing layer having a Shore D hardness of 70 or more, a tensile elongation of 320 percent or less, a storage modulus at 25 degrees C. of 1000 MPa or more, and a storage modulus at 80 degrees C. of 20 MPa or less.

16. A chemical-mechanical polishing pad comprising a non-porous thermoplastic polyurethane polishing layer having an average molecular weight of 100,000 g/mol or less, a Shore D hardness of 70 or more, a tensile elongation of 320 percent or less, a storage modulus at 25 degrees C. of 1200 MPa or more, and a storage modulus at 80 degrees C. of 15 MPa or less.

* * * * *